US006234786B1

(12) United States Patent
Wagner

(10) Patent No.: US 6,234,786 B1
(45) Date of Patent: May 22, 2001

(54) CANDLE HOLDER

(76) Inventor: Volker Wagner, Grosse Rainstrasse 31, D-22765 Hamburg (DE)

( * ) Notice: Subject to any disclaimer, the term of this patent is extended or adjusted under 35 U.S.C. 154(b) by 0 days.

(21) Appl. No.: 09/267,401

(22) Filed: Mar. 15, 1999

(51) Int. Cl.[7] ..... F23D 3/16

(52) U.S. Cl. ..... 431/295; 431/125; 431/288; 362/161; 422/125

(58) Field of Search ..... 431/291, 295, 431/125, 289, 288; 362/161–163; 422/125, 4, 5, 306

(56) References Cited

U.S. PATENT DOCUMENTS

| | | | | |
|---|---|---|---|---|
| D. 424,430 | * | 5/2000 | Seidler | D9/418 |
| D. 424,932 | * | 5/2000 | Seidler | D9/418 |
| 3,826,606 | | 7/1974 | Hicks . | |
| 3,890,085 | * | 6/1975 | Andeweg | 431/291 |
| 4,028,045 | * | 6/1977 | Reiher | 431/289 |
| 4,110,261 | * | 8/1978 | Newland | 252/522 |
| 4,614,625 | * | 9/1986 | Wilson | 431/288 |
| 5,086,380 | * | 2/1992 | Hedner Jr. | 431/291 |
| 5,578,089 | * | 11/1996 | Elsamaloty | 431/291 |
| 5,803,587 | * | 9/1998 | Chen | 362/161 |
| 5,964,905 | * | 10/1999 | Camp et al. | 431/288 |
| 6,030,093 | * | 2/2000 | Draper | 431/295 |

FOREIGN PATENT DOCUMENTS

| | | |
|---|---|---|
| 8321689 | 11/1983 | (DE) . |
| 6915556 | 12/1993 | (DE) . |
| 2566644 | 1/1986 | (FR) . |
| 2692652 | 12/1993 | (FR) . |

* cited by examiner

*Primary Examiner*—Ira S. Lazarus
*Assistant Examiner*—David Lee
(74) *Attorney, Agent, or Firm*—Venable; John P. Shannon

(57) ABSTRACT

Candle holder for a plurality of candles arranged separately from each other. Each candle comprises a cup-shaped container with a wick and wax. The candles (10, 11, 12) are arranged substantially vertically one underneath the other at such a distance that the respectively lower candle thermally influences the candle arranged above it such that its wax is melted. Said candle holder consists of a slide-in system, that can be set up to the desired distance.

3 Claims, 1 Drawing Sheet

CANDLE HOLDER

Figure 1:
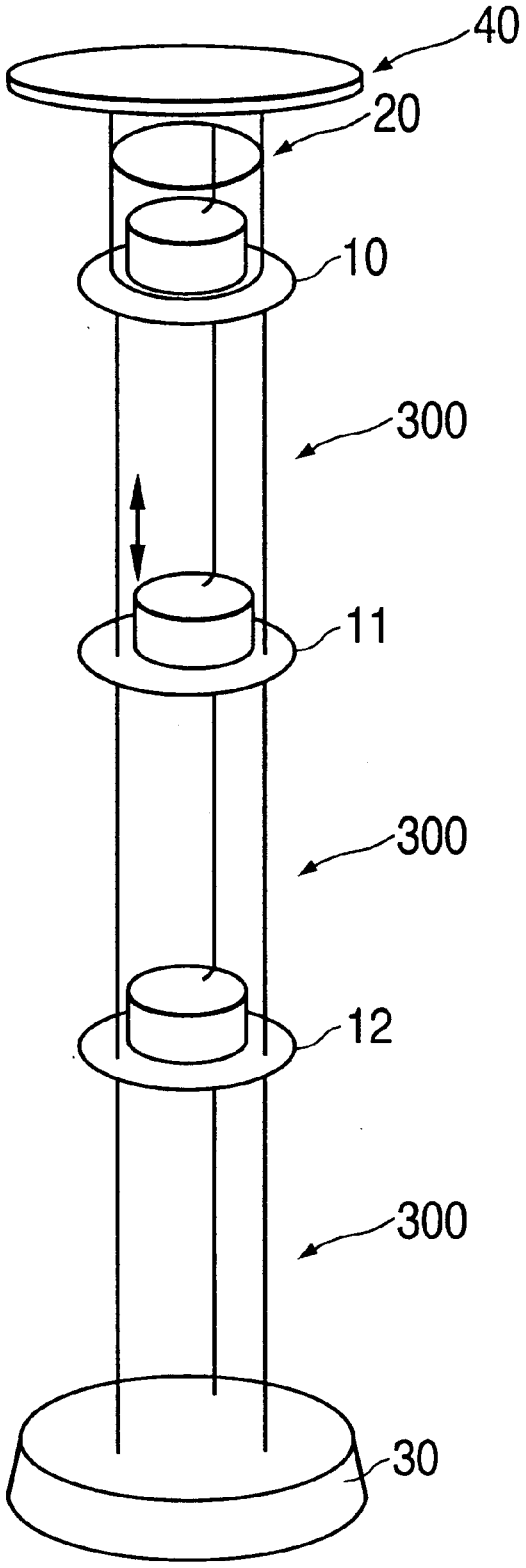

The invention relates to a candle holder with a plurality of candles arranged separately from each other, each candle comprising a cup-shaped container with a; wick and wax or the like.

Such a candle holder is known for example from FR-A-2 566 644.

In candle holders comprising several flames it is usual, to arrange the individual candles spatially separated from each other, in order to prevent that the heat generated and radiated by the flame of one candle results in the deformation of the adjacent candles.

The invention is directed to a candle holder of the type indicated above, regarding which it is aimed to be secured that the individual candles can completely burn down, even if different candles are used.

This object is achieved in that the candles are arranged substantially vertically one underneath the other at such a distance, that the respectively lower candle thermally influences the candle arranged above it such that its wax or the like is melted.

Preferably the candles are enclosed by tube pieces of transparent material.

Due to the spatial proximity, the respectively lower burning site warms-up the burning site arranged above it such, that the wax in the cup-shaped container is liquefied and thereby a complete burning down is achieved.

The distance between the individual candles in vertical direction can also be chosen such in accordance with the invention, that the lower distances are larger than the upper distances, as the liquefying of the wax also in such an arrangement occurs as a result of the heated air rising upwards.

The candle holder according to the invention is conceived as a slide-in system, in which several candles together can be slid preferably into glass containers for reception of Food Warmers or Votive Lights such, that different distances can be set.

The customer has the choice, whether he wants to put the candle holder onto the floor or to secure it on the wall.

The top part of the candle holder can optionally be used with an accessory part as a fragrance lamp.

Due to the simple, very functional shape, this candle holder can be positioned on every wall and in every corner in a very space-saving manner.

Due to the construction with three rods, the glass containers—optionally for Food Warmer or Votive Lights—are supported such that they cannot fall out and they also cannot be taken out easily by a child.

The invention will be illustrated by way of example with reference to the drawing in the following.

The figure shows a graphic illustration of a candle holder in accordance with the invention.

A foot 30 is situated at the lower end of the candle holder, which can rest on a horizontal surface. This can be a lead foot or any formation form, which makes sure that the centre of gravity of the whole candle holder is situated as low as possible.

10, 11 and 12 indicate cup-shaped candles, such as can be commercially obtained as tea lights. These candles rest on substantially circular plates, which in turn are connected with three vertically oriented rods in the shown embodiment. The rods extend from the foot 30 upwards and thereby form a rack for the individual plates and the lights.

In the figure the upper burning site 10 is enclosed by a transparent ring 20. This ring can be closed or divided, so that it could be disposed at the burning sites 11 and 12 just as well. The ring secures a quiet burning down of the flame, as it prevents that laterally directed air streams can hit the flame. Furthermore, a tube consisting of transparent material could be employed, which extends from the foot 30 up to the top.

The distances between the individual burning sites 10, 11 and 12 shown in the figure, could range from 5 to 30 cm in a practical embodiment. However, these distances are indicated by way of example only in this specification.

It is also within the scope of the present invention, to construct the candle holder as a hanging candle holder, instead of putting it onto a table.

Although the figure only shows candles of the same size, different sizes of candles with corresponding longer and smaller distances to each other can be used in accordance to the present invention. Thus, votive lights need greater distances while food warmers require only a small one.

After lighting of the candles 10, 11 and 12, the candles 11 and 10 are warmed-up and the wax, firm at the beginning, becomes liquid, and therefore it can burn down completely. The candle 12 that has not been warmed-up in that way can be put on one of the upper sites later. The connecting rods 300 are of different length and can be slid into each other.

The candles may be enclosed by small cylindrical pipes of translucent or reflecting material for decorative purposes. The uppermost light is formed as a fragrance lamp 40.

What is claimed is:

1. Candle holder with a plurality of candles arranged separately from each other, each candle comprising a cup-shaped container with a wick and meltable, fire consumable-material characterised in that the candles (10, 11, 12) are arranged substantially vertically one underneath the other at such a distance that the respectively lower candle thermally influences the candle arranged above it such that its meltable, fire consumable-material is melted.

2. Candle holder according to claim 1, characterised in that the candles are enclosed by open or closed tube pieces (20) comprising transparent or mirror material.

3. Candle holder according to claim 1, characterised in that one of the candles is the uppermost candle, and the uppermost candle is formed as a fragrance lamp (40).

* * * * *